US007869991B2

(12) United States Patent
Son

(10) Patent No.: US 7,869,991 B2
(45) Date of Patent: Jan. 11, 2011

(54) MOBILE TERMINAL AND OPERATION CONTROL METHOD FOR DELETING WHITE NOISE VOICE FRAMES

(75) Inventor: Young Joo Son, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 781 days.

(21) Appl. No.: 11/772,626

(22) Filed: Jul. 2, 2007

(65) Prior Publication Data

US 2008/0133229 A1 Jun. 5, 2008

(30) Foreign Application Priority Data

Jul. 3, 2006 (KR) ..... 10-2006-0061920

(51) Int. Cl.
*G10L 11/02* (2006.01)
*G10L 21/02* (2006.01)

(52) U.S. Cl. ..... 704/210; 704/215; 704/501

(58) Field of Classification Search ..... 704/201, 704/210, 215, 226, 501; 370/470, 472, 521; 455/223

See application file for complete search history.

(56) References Cited

U.S. PATENT DOCUMENTS 5,396,516 A * 3/1995 Padovani et al. ..... 375/225
5,751,725 A * 5/1998 Chen ..... 714/708
5,802,105 A * 9/1998 Tiedemann et al. ..... 375/225
6,697,343 B1 * 2/2004 Kamel et al. ..... 370/311
7,061,934 B2 * 6/2006 El-Maleh et al. ..... 370/466
7,080,009 B2 * 7/2006 Proctor et al. ..... 704/221
7,110,947 B2 * 9/2006 Cox et al. ..... 704/236
7,245,878 B2 * 7/2007 Lin et al. ..... 455/63.1
7,292,550 B2 * 11/2007 Dunn et al. ..... 370/331
7,386,327 B2 * 6/2008 Ryu et al. ..... 455/570
7,499,403 B2 * 3/2009 Ejzak et al. ..... 370/236
7,519,532 B2 * 4/2009 Rabha ..... 704/219
7,542,897 B2 * 6/2009 Hutchison et al. ..... 704/214
2002/0120439 A1 * 8/2002 Mekuria et al. ..... 704/215
2006/0171419 A1 * 8/2006 Spindola et al. ..... 370/477

* cited by examiner

*Primary Examiner*—Martin Lerner
(74) *Attorney, Agent, or Firm*—Birch, Stewart, Kolasch & Birch, LLP

(57) ABSTRACT

A mobile terminal and method of eliminating a call sound noise thereof are disclosed, by which a user can have a call of a clear sound quality by removing a frame including a white noise from a voice frame received from an originator terminal. The present invention includes a communicating unit receiving a voice frame; a control unit deleting the voice frame, if a white noise is included in the voice frame; an audio processing unit decoding the voice frame under the control of the control unit.

6 Claims, 3 Drawing Sheets

MOBILE TERMINAL AND OPERATION CONTROL METHOD FOR DELETING WHITE NOISE VOICE FRAMES

This application claims the benefit of the Korean Patent Application No. 10-2006-0061920, filed on Jul. 3, 2006, which is hereby incorporated by reference as if fully set forth herein.

BACKGROUND OF THE INVENTION

1. Field of the Invention

The present invention relates to an apparatus for a mobile terminal, and more particularly, to a mobile terminal and method of eliminating a call sound noise thereof. Although the present invention is suitable for a wide scope of applications, it is particularly suitable for eliminating a white noise generated during a call of the mobile terminal.

2. Discussion of the Related Art

Generally, while a call is connected between mobile terminals, an interval, for which an originator does not talk to a recipient, is called a speechless interval.

In particular, a recipient terminal does not receive a voice of a user of an originator terminal during the speechless interval but receives a signal containing peripheral noise of the originator terminal, i.e., a white noise.

As a voice encoder of a mobile terminal, an enhanced variable rate speed codec (hereinafter abbreviated EVRC) vocoder is widely used.

The EVRC is used for the synchronous CDMA mobile phone service and is a system for encoding voice information variably according to an information amount of voice.

In particular, since the voice information amount is considerably large in a speech interval for which a caller speaks much, encoding is carried out at a high rate.

In the speechless interval for which a caller does not speak, the voice information amount is almost zero, encoding is carried out at a low rate.

Thus, the vocoder of the originator terminal transmits a white noise during a speechless interval to the recipient terminal in a manner of compressing the white noise into data having an information amount ⅛ smaller than that of a normal speech interval.

However, if the data compressed at the ⅛ rate is decoded by the recipient terminal, it is decoded into a white noise to generate a noise while a call is processed.

So, an automatic audio gain control (AGC) is used to eliminate the white noise, which brings about other problems such as voice fluctuations in a call, voice disconnections in a call, and the like.

SUMMARY OF THE INVENTION

Accordingly, the present invention is directed to a mobile terminal and method of eliminating a call sound noise thereof that substantially obviate one or more of the problems due to limitations and disadvantages of the related art.

An object of the present invention is to provide a mobile terminal and method of eliminating a call sound noise thereof, by which a user can have a call of a clear sound quality by removing a frame including a white noise from a voice frame received from an originator terminal.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Figure 1:
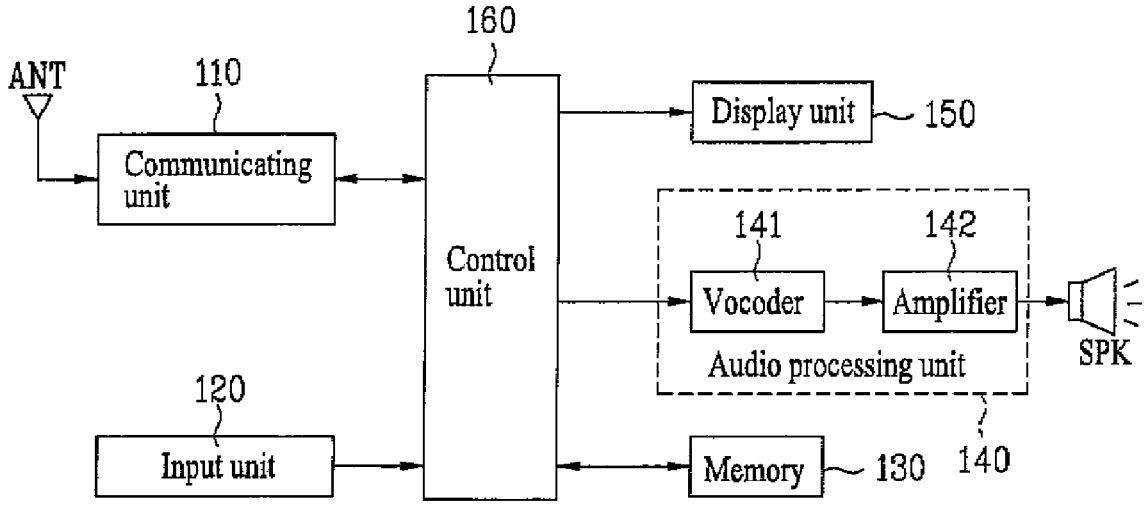
FIG. 1 is a block diagram of a mobile terminal according to the present invention.

Additional features and advantages of the invention will be set forth in the description which follows, and in part will be apparent from the description, or may be learned by practice of the invention.

The objectives and other advantages of the invention will be realized and attained by the structure particularly pointed out in the written description and claims thereof as well as the appended drawings.

To achieve these and other advantages and in accordance with the purpose of the present invention, as embodied and broadly described, a mobile terminal according to the present invention includes a communicating unit receiving a voice frame; a control unit deleting the voice frame, if a white noise is included in the voice frame; an audio processing unit decoding the voice frame under the control of the control unit.

Preferably, the control unit recognizes the voice frame as a frame of a speechless interval including the white noise, if an encoding rate of the voice frame is equal to a preset rate.

Preferably, the control unit recognizes that the white noise is included in the voice frame, if an encoding rate of the voice frame is ⅛ encoding rate.

Preferably, the control unit controls a length of the deleted voice frame to be set to 0 byte in order for the audio processing unit not to decode the voice frame.

To further achieve these and other advantages and in accordance with the purpose of the present invention, a method of eliminating a call sound noise of a mobile terminal includes receiving a voice frame; deciding whether a white noise is included in the voice frame; deleting the voice frame according to the deciding result.

Preferably, the deciding step includes recognizing an encoding rate of the voice frame; checking whether the recognized encoding rate is equal to a preset rate; deciding the voice frame as a frame in a speechless interval including the white noise, if the recognized encoding rate is equal to the preset rate.

More preferably, in the checking step, it is checked whether the recognized encoding rate of the voice frame is ⅛ encoding rate.

Preferably, in the deleting step, by setting a length of the deleted voice frame to 0 byte, the voice frame is prevented from being decoded.

To further achieve these and other advantages and in accordance with the purpose of the present invention, a mobile terminal includes a communicating unit receiving a voice frame; a control unit deleting the voice frame, if an encoding rate of the voice frame is equal to a preset rate; an audio processing unit decoding the voice frame under the control of the control unit.

More preferably, the control unit deletes the voice frame, if the encoding rate of the voice frame is ⅛ encoding rate.

And, the control unit controls a length of the deleted voice frame to be set to 0 byte in order for the audio processing unit not to decode the voice frame.

To further achieve these and other advantages and in accordance with the purpose of the present invention, a method of eliminating a call sound noise of a mobile terminal includes receiving a voice frame; deciding whether an encoding rate of the voice frame is equal to a preset rate; deleting the voice frame according to the deciding result.

Preferably, in the deciding step, it is decided whether the encoding rate of the voice frame is ⅛ encoding rate.

Preferably, in the deleting step, a length of the deleted voice frame is set to 0 byte in order for the voice frame not to be decoded.

It is to be understood that both the foregoing general description and the following detailed description are exemplary and explanatory and are intended to provide further explanation of the invention as claimed.

Reference will now be made in detail to the preferred embodiments of the present invention, examples of which are illustrated in the accompanying drawings.

First of all, the present invention is applicable to a terminal capable of mobile communications such as a digital broadcast receiving terminal, a PDA, a mobile phone, and the like.

For convenience and simplicity of explanation in the following description, it is assumed that the present invention is applied to a mobile terminal such as a mobile phone. Yet, the present invention is not limited to the mobile terminal only. So, it should be understood that the present invention is not restricted by the following explanation and embodiments.

FIG. 1 is a block diagram of a mobile terminal according to the present invention.

Referring to FIG. 1, a mobile terminal to eliminate a white noise in the course of a call includes an antenna (ANT), a communicating unit 110, an input unit 120, a memory 130, an audio processing unit 140, a speaker (SPK), a display unit 150, and a control unit 160. And, the audio processing unit 140 includes a vocoder 141 and an amplifier 142.

The communicating unit 110 is controlled by the control unit 160. If a signal on a frequency band is received via the ANT, the communicating unit 110 demodulates the received signal and then outputs the demodulated signal to the control unit 160 or the audio processing unit 120.

The communicating unit 110 modulates data generated by the control unit 160 or a voice frame inputted from the audio processing unit 140 and then outputs the modulated signal as a radio signal via the ANT.

The input unit 120 is a user interface that is provided with a plurality of numeral keys and function keys. And, the input unit 120 outputs key signals for the keys to the control unit 160. Preferably, the input unit 120 can include a touch pad or a touch screen according to a configuration of the mobile terminal.

The memory 130 stores a prescribed program for controlling overall operations of the mobile terminal and various kinds of data inputted or outputted in executing the control operation of the mobile terminal.

The audio processing unit 140 decodes to output the voice frame received from the communicating unit 110.

Preferably, the audio processing unit 140 includes the vocoder 141 and the amplifier 142.

The vocoder 141 includes an EVRC (Enhanced Variable Rate Codec) vocoder or a QCLEP (Qualcomm Code Excited Linear Prediction) vocoder. The vocoder 141 recognizes an encoding rate of the voice frame received from the communicating unit 110 and then decodes the voice frame at a decoding rate equal to the encoding rate.

For instance, if the encoding rate of the voice frame is ⅛ rate, the vocoder 141 decodes the voice frame at the ⅛ rate.

The vocoder 141 provides the control unit 160 with information for the recognized encoding rate of the voice frame.

The vocoder 141 decodes the voice frame received from the communicating unit 110 under the control of the control unit 160.

The amplifier 142 amplifies the voice frame decoded by the vocoder 141 into a preset level and then outputs the amplified signal to the SPK.

Under the control of the control unit 160, the display unit 150 receives display data corresponding to the key signal from the input unit 120 and then displays the received data. And, the display unit 150 displays an operational status of the mobile terminal and a plurality of informations as icons and characters.

And, the control unit 160 controls the overall operations of the mobile terminal.

A method of eliminating a call sound noise according to the present invention is explained in detail with reference to FIG. 2 as follows.

Figure 2:
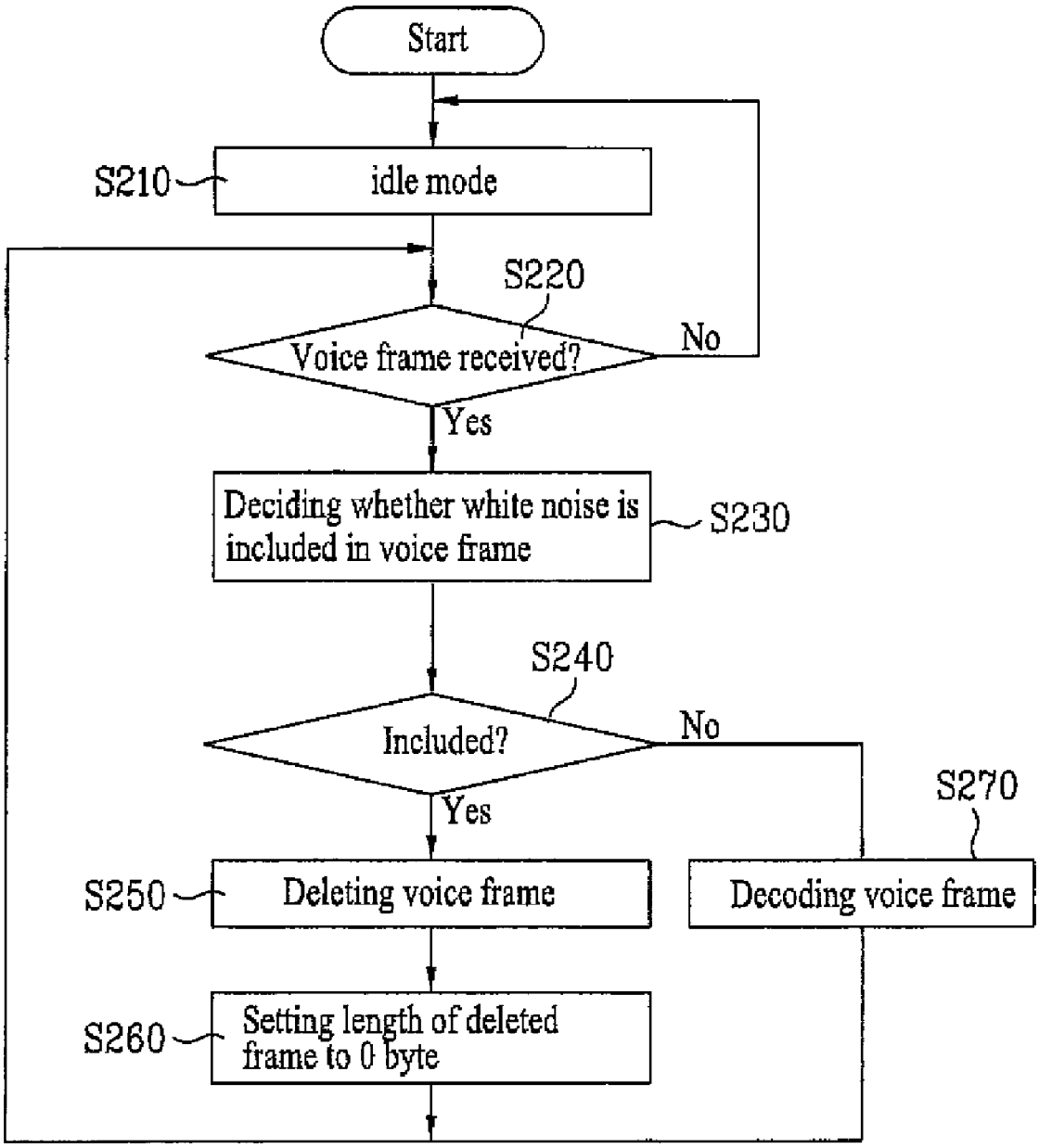
FIG. 2 is a flowchart of a method of eliminating a call sound noise of a mobile terminal according to one embodiment of the present invention.

FIG. 2 is a flowchart of a method of eliminating a call sound noise of a mobile terminal according to one embodiment of the present invention.

Referring to FIG. 2, while the control unit 160 is in a idle mode (S210), if a call is connected with an originator terminal, the control unit 160 checks whether a voice frame of the originator terminal is received from the communicating unit 110 (S220).

If the voice frame is received, the control unit 160 decides whether a white noise is included in the voice frame (S230).

The step S230 of the control unit 160 is explained in detail with reference to FIG. 3 as follows.

Figure 3:
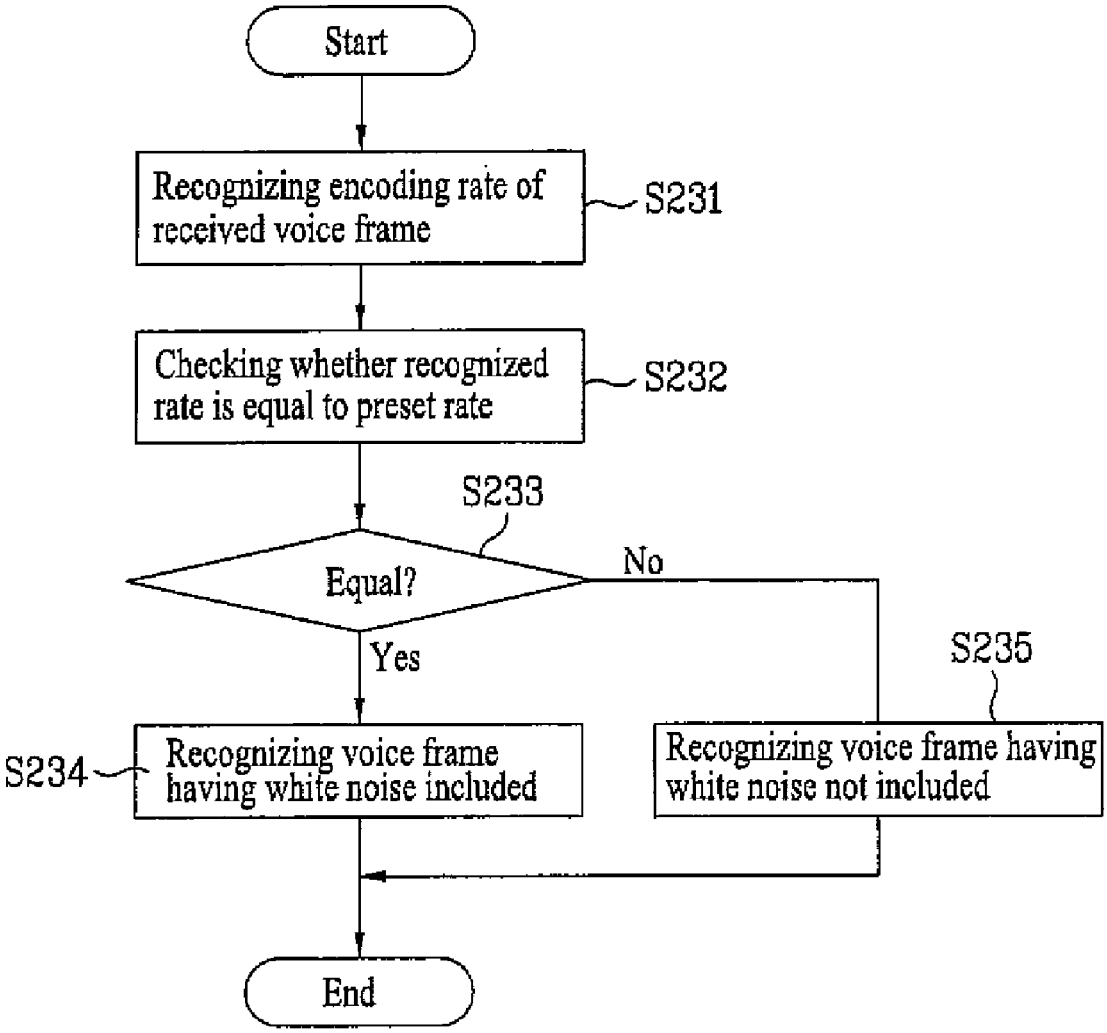
FIG. 3 is a flowchart of a process for deciding whether a white noise is included in a voice frame according to one embodiment of the present invention.

FIG. 3 is a flowchart of a process for deciding whether a white noise is included in a voice frame according to one embodiment of the present invention.

Referring to FIG. 3, if the voice frame is received, the control unit 160 recognizes information for an encoding rate of the voice frame via the vocoder 141 (S231).

The control unit 160 checks whether the recognized encoding rate information is equal to a prescribed encoding rate set in the memory 130 (S232).

Preferably, the prescribed encoding rate set in the memory 130 is ⅛ encoding rate.

If the recognized encoding rate information is equal to the preset ⅛ encoding rate (S233), the control unit 160 recognizes the received voice frame as a frame in a speechless interval including a white noise (S234).

If the recognized encoding rate information is not equal to the preset ⅛ encoding rate, the control unit 160 recognizes the received voice frame as a frame in a speech interval not including a white noise (S235).

In particular, in the present invention, the voice frame is encoded and transmitted at ⅛ rate during the speechless interval for which the white noise is introduced from the originator terminal.

So, in case of recognizing that the white noise is included in the received voice frame according to the steps shown in FIG. 2, the control unit 160 deletes the voice frame (S250) and then sets a length of the voice frame to 0 byte (S260).

Thus, the control unit 160 sets the length of the deleted frame to 0 byte, which is to prevent a decoding error of the deleted voice frame in the vocoder 141.

In case of recognizing that the white noise is not included in the received voice frame according to the steps shown in FIG. 2, the control unit 160 controls the vocoder 141 to decode the voice frame (S270).

The present invention provides the following effects or advantages.

First of all, a user can have a call of a clear sound quality by removing a frame including a white noise from a voice frame received from an originator terminal.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A recipient mobile terminal receiving voice frames from an originator mobile terminal, the recipient mobile terminal comprising:

a communicating unit configured to receive voice frames from the originator terminal if a call is connected with the originator terminal;

a vocoder configured to recognize an encoding rate of the received voice frames, to output the recognized encoding rate of the voice frames, and to decode the voice frames at a decoding rate equal to the recognized encoding rate;

an amplifier configured to amplify the voice frames decoded by the vocoder and then to output the amplified voice frames to a speaker of the recipient mobile terminal; and a control unit configured to:

recognize the encoding rate of the voice frames via the vocoder before the voice frames are decoded by the vocoder, search for at least one voice frame that is equal to a preset encoding rate in the recognized encoding rate of the voice frames before the voice frames are decoded by the vocoder, delete the searched at least one voice frame of the voice frames before the voice frames are decoded by the vocoder, and control the vocoder to decode the voice frames after the searched at least one voice frame is deleted.

2. The mobile terminal of claim 1, wherein the preset encoding rate is an ⅛ encoding rate, and the control unit recognizes that a white noise is included in the at least one voice frame if the recognized encoding rate of the at least one voice frame is the ⅛ encoding rate and deletes the at least one voice frame including the white noise.

3. The mobile terminal of claim 1, wherein the control unit controls a length of the deleted voice frame to be set to 0 byte.

4. A method of eliminating a call sound noise of a recipient mobile terminal, the method comprising:

receiving, at a communicating unit of the recipient mobile terminal, voice frames from an originator terminal if a call is connected with the originator terminal;

recognizing, by a vocoder of the recipient mobile terminal, an encoding rate of the voice frames received from the communicating unit before the voice frames are decoded by the vocoder;

searching, by the recipient mobile terminal, for at least one voice frame of the voice frames that is equal to a preset encoding rate in the recognized encoding rate of the voice frames before the voice frames are decoded by the vocoder;

deleting, by the recipient mobile terminal, the searched at least one voice frame in the voice frames before the voice frames are decoded by the vocoder; and decoding, by the vocoder of the recipient mobile terminal, the voice frames after the searched at least one voice frame is deleted.

5. The method of claim 4, wherein the preset encoding rate is an ⅛ encoding rate, and the recipient mobile terminal searches whether the recognized encoding rate of the at least one voice frame is the ⅛ encoding rate.

6. The method of claim 4, further comprising:

setting a length of the deleted voice frame to 0 byte.

* * * * *